US010626518B2

(12) United States Patent
Zhan et al.

(10) Patent No.: US 10,626,518 B2
(45) Date of Patent: Apr. 21, 2020

(54) METHOD FOR TREATING A SURFACE OF A METALLIC STRUCTURE

(71) Applicant: City University of Hong Kong, Kowloon (HK)

(72) Inventors: Yawen Zhan, Kowloon (HK); Yangyang Li, Kowloon (HK); Jian Lu, Kowloon (HK)

(73) Assignee: City University of Hong Kong, Kowloon (HK)

( * ) Notice: Subject to any disclaimer, the term of this patent is extended or adjusted under 35 U.S.C. 154(b) by 115 days.

(21) Appl. No.: 16/068,532

(22) PCT Filed: May 31, 2016

(86) PCT No.: PCT/CN2016/084027

§ 371 (c)(1),
(2) Date: Jul. 6, 2018

(87) PCT Pub. No.: WO2017/206050

PCT Pub. Date: Dec. 7, 2017

(65) Prior Publication Data

US 2019/0010627 A1 Jan. 10, 2019

(51) Int. Cl.

| | |
|---|---|
| ***C25F 3/02*** | (2006.01) |
| ***C25D 3/56*** | (2006.01) |
| ***C25D 7/00*** | (2006.01) |

(52) U.S. Cl.

CPC ..... *C25F 3/02* (2013.01); *C25D 3/56* (2013.01); *C25D 7/00* (2013.01)

(58) Field of Classification Search

None

See application file for complete search history.

(56) References Cited

U.S. PATENT DOCUMENTS

| | | | | |
|---|---|---|---|---|
| 9,840,789 | B2 * | 12/2017 | Zhang | C25F 3/02 |
| 2009/0218234 | A1 | 9/2009 | Jayaraman | |
| 2010/0068623 | A1 | 3/2010 | Braun et al. | |
| 2014/0221700 | A1 * | 8/2014 | Radivojevic | B01J 25/02 568/885 |
| 2015/0184309 | A1 | 7/2015 | Zhang et al. | |

FOREIGN PATENT DOCUMENTS

| | | |
|---|---|---|
| CN | 101104940 | 1/2008 |

OTHER PUBLICATIONS

Zhan et al. "Bestow metal foams with nanostructured surfaces via a convenient electrochemical method for improved device performance," 9(8) Nano Research 2364 (2016) (Year: 2016).*

* cited by examiner

*Primary Examiner* — Nicholas A Smith

(74) *Attorney, Agent, or Firm* — Renner Kenner Grieve Bobak Taylor & Weber

(57) ABSTRACT

A method for treating a surface of a metallic structure, the metallic structure being made of a first metallic material; the method including the steps of: (a) bonding an alloy material made of the first metallic material and a second metallic material with the structure; and (b) etching away at least some of the first metallic material from a structure obtained after step (a) so as to obtain a treated structure with an increased specific surface area compared with the metallic structure before treatment.

31 Claims, 10 Drawing Sheets

| Spectrum | In stats. | Cu | Total |
|---|---|---|---|
| Spectrum 1 | Yes | 100.00 | 100.00 |
| Spectrum 2 | Yes | 100.00 | 100.00 |
| Spectrum 3 | Yes | 100.00 | 100.00 |
| Spectrum 4 | Yes | 100.00 | 100.00 |
| Spectrum 5 | Yes | 100.00 | 100.00 |
| Mean | | 100.00 | 100.00 |
| Std. deviation | | 0.00 | |
| Max. | | 100.00 | |
| Min. | | 100.00 | |

METHOD FOR TREATING A SURFACE OF A METALLIC STRUCTURE

TECHNICAL FIELD

The present invention relates to a method for treating a surface of a metallic structure and particularly, although not exclusively, to a method for electrochemically treating a surface of a metal foam so as to obtain a nanostructured surface on the metal foam. The treated structure has increased specific surface area and surface roughness, and can be used as electrodes, filters, absorbers, catalysts, and sensors in different applications.

BACKGROUND

As a type of 3D porous bulk material, metal foams are of great practical importance in many engineering fields. Conventionally, metal foams have been widely used for heat exchangers, filters, energy and sound absorbers. Recently, open-cell metal foams have caught much attention for their new applications as charge collectors/mass support for the electro-active materials for lithium ion batteries (LIBs), super-capacitors, fuel cells, and sensors. Compared with porous nano-materials, open-cell metal foams stand out for their low cost, easy fabrication, good mechanical properties, high porosity, light weight, and high thermal and electrical conductivities. The decent-sized (e.g., several centimeters thick) and robust framework offered by open-cell metal foams are extremely attractive for simple and fast device integration and assembly.

SUMMARY OF THE INVENTION

In accordance with a first aspect of the present invention, there is provided a method for treating a surface of a metallic structure, the metallic structure being made of a first metallic material; the method comprising the steps of: (a) bonding an alloy material made of the first metallic material and a second metallic material with the metallic structure; and (b) removing or etching away at least some of the first metallic material from a structure obtained after step (a) so as obtain a treated structure with an increased specific surface area compared with the metallic structure before treatment. Preferably, the metallic structure is being made of the first metallic material only; and the alloy material is made of the first metallic material and the second metallic material only. In one embodiment, the first metallic material etched away at step (b) belongs to the alloy material and the original metallic structure. In another embodiment, the first metallic material etched away at step (b) belongs to the alloy material only.

In one embodiment of the first aspect, the treated structure has a nanostructured surface with nano-pores (pores that are of nano-scale).

In one embodiment of the first aspect, step (a) comprises electrodepositing the alloy material onto the metallic structure.

In one embodiment of the first aspect, an electrochemical cell is used for electrodepositing the alloy material onto the metallic structure; the electrochemical cell comprises a first electrode, a second electrode and an electrolyte in electrical connection; wherein the metallic structure to be treated being connected as the first electrode; and the electrolyte comprises a solution with ions of the first metallic material and ions of the second metallic material. Preferably, the electrochemical cell has an extra third reference electrode.

In one embodiment of the first aspect, the solution of the electrolyte further comprises an acid. The acid may be boric acid.

In one embodiment of the first aspect, step (b) comprises electrochemically de-alloying at least some of the first metallic material. In one embodiment, the first metallic material de-alloyed at step (b) belongs to the alloy material and the original metallic structure. In another embodiment, the first metallic material de-alloyed at step (b) belongs to the alloy material only.

In one embodiment of the first aspect, the de-alloying in step (b) is carried out in a solution with ions of the first metallic material, ions of the second metallic material and an acid. In one embodiment, the solution used in step (b) may contain the solution of the electrolyte used in step (a).

In one embodiment of the first aspect, the de-alloying in step (b) is carried out in an acidic solution comprising or further comprising HCl, $HNO_3$, $H_2SO_4$, or ammonium.

In one embodiment of the first aspect, the electrodeposition in step (a) is carried out by applying a first voltage for a first duration to the metallic structure; and the de-alloying in step (b) is carried out by applying a second voltage different from the first voltage for a second duration to the structure obtained after step (a). The first and second durations are preferably the same but they may also be different.

In one embodiment of the first aspect, the first duration is 1 second to 60 seconds.

In one embodiment of the first aspect, the second duration is 1 second to 60 seconds.

In one embodiment of the first aspect, one of the first voltage and the second voltage is a negative voltage, and another of the first voltage and the second voltage is a positive voltage. In one example, the first and second voltages may be in the form of a voltage wave such as AC square or sinusoidal voltage wave. Preferably, the wave is periodic.

In one embodiment of the first aspect, in step (b) at least some or all of the second metallic material is detached from the structure obtained after step (a) as the first metallic material is etched away. The detachment is preferably due to undercutting.

In one embodiment of the first aspect, the second metallic material detached from the structure obtained after step (a) is in a form of particles.

In one embodiment of the first aspect, the detached second metallic material particles have nano-pores (pores that are of nano-scale).

In one embodiment of the first aspect, the method further comprises the step of (c): repeating steps (a) and (b).

In one embodiment of the first aspect, steps (a) and (b) are repeated for 20 to 160 times. In another embodiment of the first aspect, steps (a) and (b) may be repeated for 1 to 300 times, depending on the desired surface nanostructure of the treated structure.

In one embodiment of the first aspect, the alloy material may be in the form of micro-isles, particles, granules, etc.

In one embodiment of the first aspect, the first metallic material is chemically more reactive than the second metallic material.

In one embodiment of the first aspect, the first metallic material is an aluminium-based material, a copper-based material, a zinc-based material, or a silver-based material; and the second metallic material is a nickel-based material, platinum, or gold. In a preferred embodiment of the first aspect, the first metallic material is aluminium, copper, zinc, or silver; and the second metallic material is nickel, platinum, or gold. In another embodiment, other metallic materials can be used as long as the first metallic material is chemically more reactive than the second metallic material.

In one embodiment of the first aspect, the metallic structure is porous. The metallic structure may be in the form of a foam, a foil, a wire, or a mesh.

In one embodiment of the first aspect, the metallic structure is a closed-cell metal foam. In a preferred embodiment of the first aspect, the metallic structure is an open-cell metal foam. Examples of these metal foams include aluminium foam, cadmium foam, cobalt foam, copper foam, iron foam, lead foam, molybdenum foam, nickel foam, niobium foam, rhenium foam, silver foam, tantalum foam, tin foam, titanium foam, zinc foam, etc.

In one embodiment of the first aspect, the method further comprises the step of (d) generating, bonding or coating a metallic or metallic oxide material on a surface of the treated structure.

In one embodiment of the first aspect, the method further comprises the step of (e) generating, bonding or coating an electro-active or photocatalytic oxide material on a surface of the treated structure.

In one embodiment of the first aspect, the method further comprises the step of (f) modifying a surface of the treated structure using thermal treatment. In one example, nanowire structures may be grown or formed on the treated structure using thermal oxidation.

In accordance with a second aspect of the present invention, there is provided a method for treating a surface of an open-cell metal foam, the open-cell metal foam being made of a first metallic material; the method comprising the steps of: (a) electrodepositing alloy material micro-isles made of the first metallic material and a second metallic material onto the open-cell metal foam; and (b) electrochemically de-alloying at least some of the first metallic material from a structure obtained after step (a) so as obtain a treated open-cell metal foam with a nanostructured surface having nano-pores. Preferably, the open-cell metal foam is being made of the first metallic material only; and the alloy material micro-isles are made of the first metallic material and the second metallic material only. In one embodiment, the first metallic material de-alloyed at step (b) belongs to the alloy material and the open-cell metal foam. In another embodiment, the first metallic material de-alloyed at step (b) belongs to the alloy material only.

In one embodiment of the second aspect, the method further comprises the step of (c) repeating steps (a) and (b). Preferably, steps (a) and (b) are repeated for 1 to 300 times, and more preferably, 20 to 160 times, depending on the desired surface nano structure of the treated structure.

In one embodiment of the second aspect, the method further comprises at least one of the following step: (d) generating, bonding or coating a metallic or metallic oxide material on a surface of the treated open-cell metal foam; (e) generating, bonding or coating an electro-active or photocatalytic oxide material on a surface of the treated open-cell metal foam; and (f) modifying a surface of the treated open-cell metal foam using thermal treatment.

In one embodiment of the second aspect, in step (b) at least some or all of the second metallic material is detached from the structure obtained after step (a) as the first metallic material is de-alloyed, and wherein the detached second metallic material is a form of particles having nano-pores (pores that are of nano-scale). The detachment is preferably due to undercutting.

In one embodiment of the second aspect, the first metallic material is an aluminium-based material, a copper-based material, a zinc-based material, or a silver-based material; and the second metallic material is a nickel-based material, platinum, or gold. In a preferred embodiment of the first aspect, the first metallic material is aluminium, copper, zinc, or silver; and the second metallic material is nickel, platinum, or gold. In another embodiment, other metallic materials can be used as long as the first metallic material is chemically more reactive than the second metallic material.

Examples of the metal foams in the embodiments of the second aspect include aluminium foam, cadmium foam, cobalt foam, copper foam, iron foam, lead foam, molybdenum foam, nickel foam, niobium foam, rhenium foam, silver foam, tantalum foam, tin foam, titanium foam, zinc foam, etc.

In accordance with a third aspect of the present invention, there is provided a metallic structure produced using the method in accordance with the first aspect of the present invention.

In accordance with a fourth aspect of the present invention, there is provided an open-cell metal foam produced using the method in accordance with the second aspect of the present invention.

It is an object of the present invention to address the above needs, to overcome or substantially ameliorate the above disadvantages or, more generally, to provide an improved method for treating a surface of a metallic structure, and in particular, an open-cell metal foam.

BRIEF DESCRIPTION OF THE DRAWINGS

Embodiments of the present invention will now be described, by way of example, with reference to the accompanying drawings in which.

Figure 2:
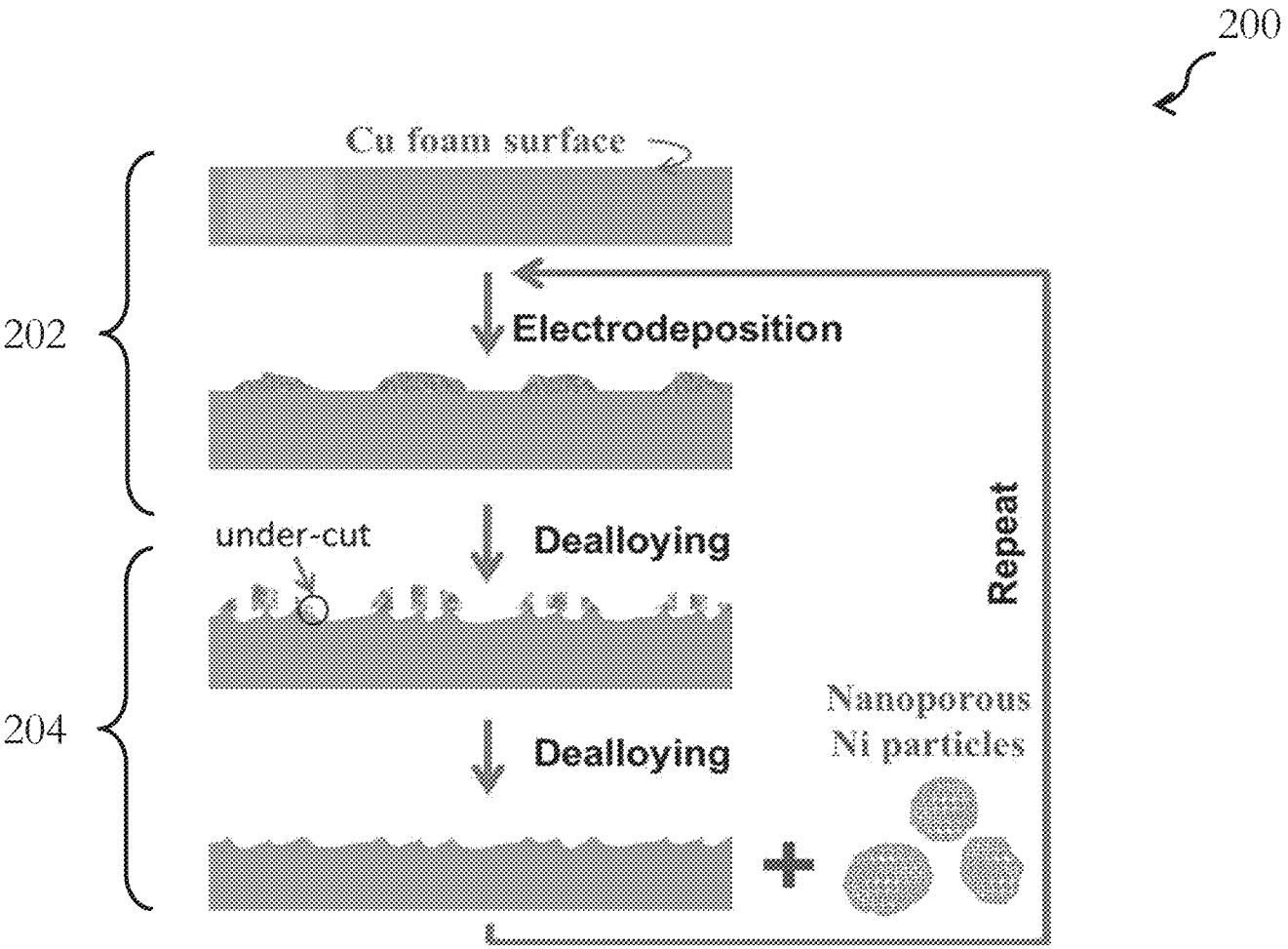
FIG. 2 is a flow diagram showing an exemplary application of the method of FIG. 1, and it specifically illustrates an exemplary fabrication procedure for roughening the surface of an open-cell copper foam.
Figure 7B:
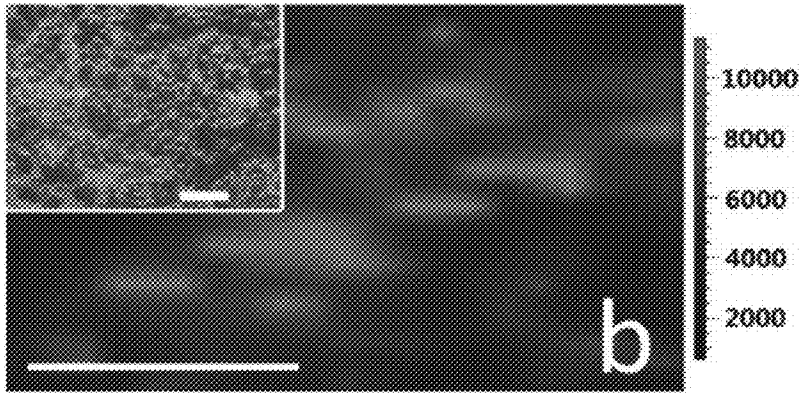
Figure 7A:
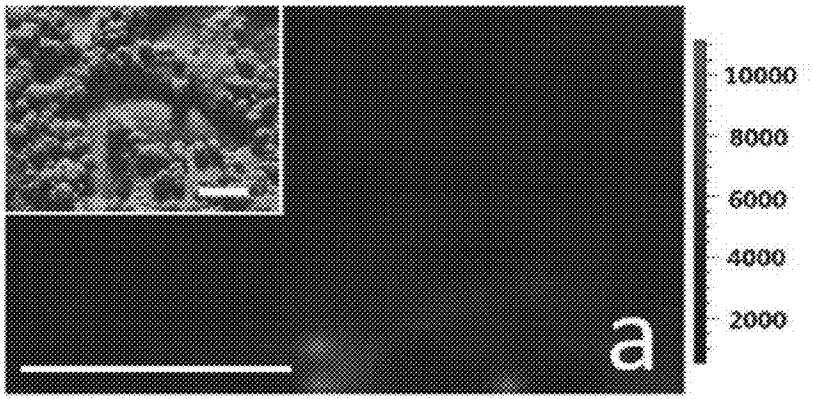
Figure 8A:
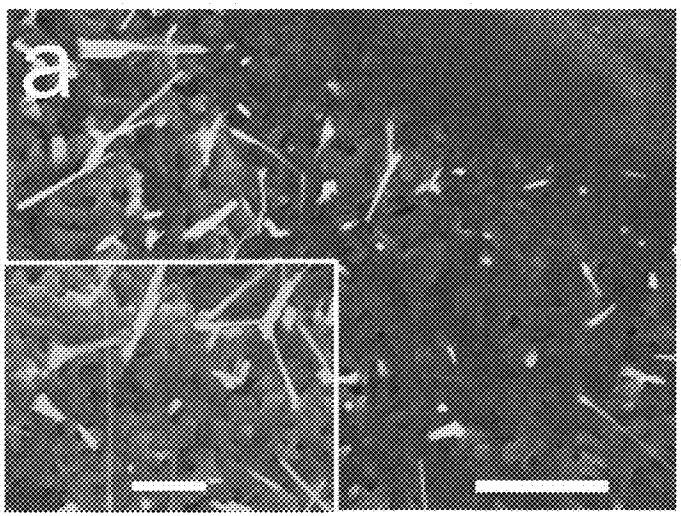
Figure 8B:
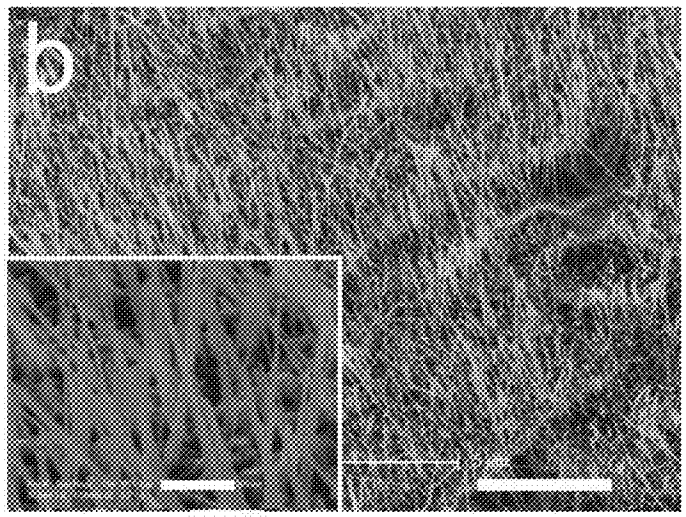
Figure 9:
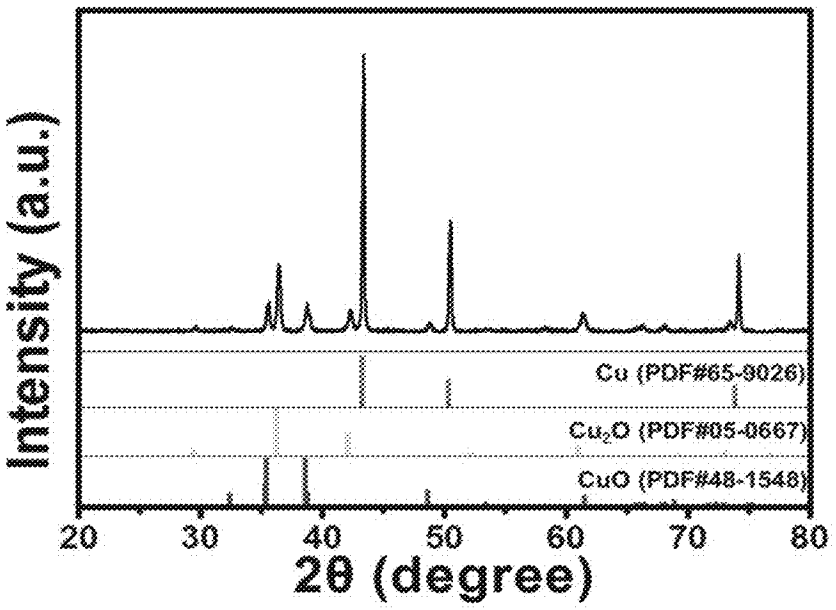
Figure 10A:
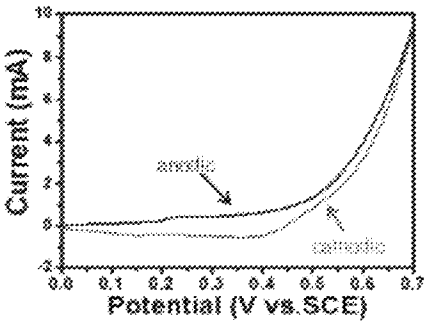
Figure 10B:
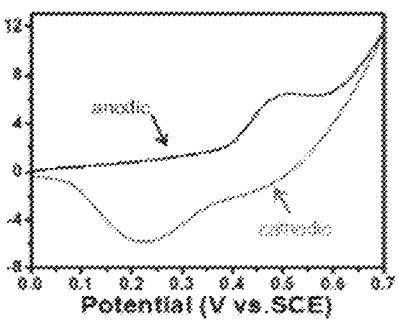
Figure 10C:
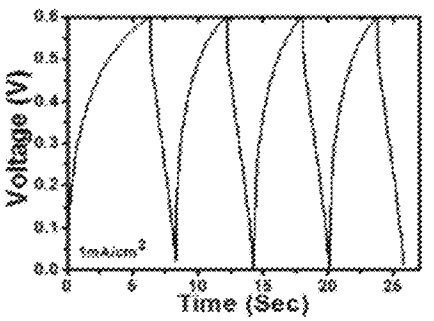
Figure 10D:
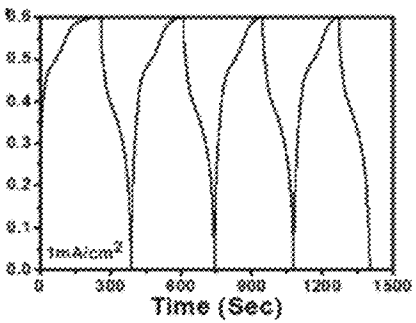
Figure 10E:
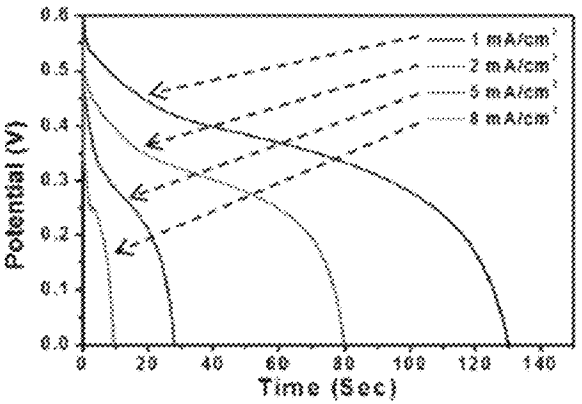

2 in which the electrodeposition duration is 10 seconds, the dealloying duration is 10 seconds and the cycle number is 80;

FIG. 7*a* shows a Surface-Enhanced Raman Scattering (SERS) mapping image of the original copper foam without being treated with the method of FIG. 2 and being decorated with silver nanoparticles;

FIG. 7*b* shows a Surface-Enhanced Raman Scattering (SERS) mapping image of the copper foam treated using the method of FIG. 2 being decorated with silver nanoparticles;

FIG. 8*a* shows a SEM image (with a low magnification view and a high magnification insert) of original copper foam without being treated with the method of FIG. 2 and being thermally oxidized;

FIG. 8*b* shows a SEM image (with a low magnification view and a high magnification insert) of copper foam treated using the method of FIG. 2 being thermally oxidized;

FIG. 9 is an XRD pattern of the copper foam roughened using the method of FIG. 2 after thermal oxidation, in comparison with the standard JCPDS patterns of Cu, Cu2O and CuO;

FIG. 10*a* shows the cyclic voltammogram of the copper oxide nanowires grown on an original untreated copper foam;

FIG. 10*b* shows the cyclic voltammogram of the copper oxide nanowires grown on a copper foam treated using the method of FIG. 2;

FIG. 10*c* shows the charge/discharge curve of the copper oxide nanowires grown on the original untreated copper foam;

FIG. 10*d* shows the charge/discharge curve of the copper oxide nanowires grown on a copper foam treated using the method of FIG. 2; and FIG. 10*e* shows the chronopotentiometric curves of different current density for the oxide nanowires grown on the roughened copper foam.

DETAILED DESCRIPTION OF THE PREFERRED EMBODIMENT

The Inventors of the present application has devised, through experiments and trials, that for most applications of open-cell metal foams, a large specific surface area is highly desirable as it can provide a large working surface area for coating catalytic or electro-active materials, maximize material usage, and thus enhance device performance (e.g., allowing higher charge/discharge rates and higher capacity for charge-storage devices). The Inventors of the present application has also noted that current commercial metal foams possess bulky structural features (ligaments and pores on the scale of sub-millimeters) and smooth ligament walls, which result from manufacturing process generally involving introducing gas, fillers or blowing agents to metals and sintering/annealing treatments. And as a result, current metal foams display rather small specific surface areas (typically 0.003-0.1 $m^2/g$), limiting their applications in sensors, catalysts, fuel cells and charge storage devices.

The Inventors of the present application has devised a convenient and economical electrochemical approach to bestow a nanostructured surface of large area upon the 3D bulk metal foams or other metallic structures. Through directly modifying the metal foam by carving its ligaments to generate surface roughness and nano-pores, the surface area of the metal foams or other metallic structures can be effectively increased.

Figure 1:
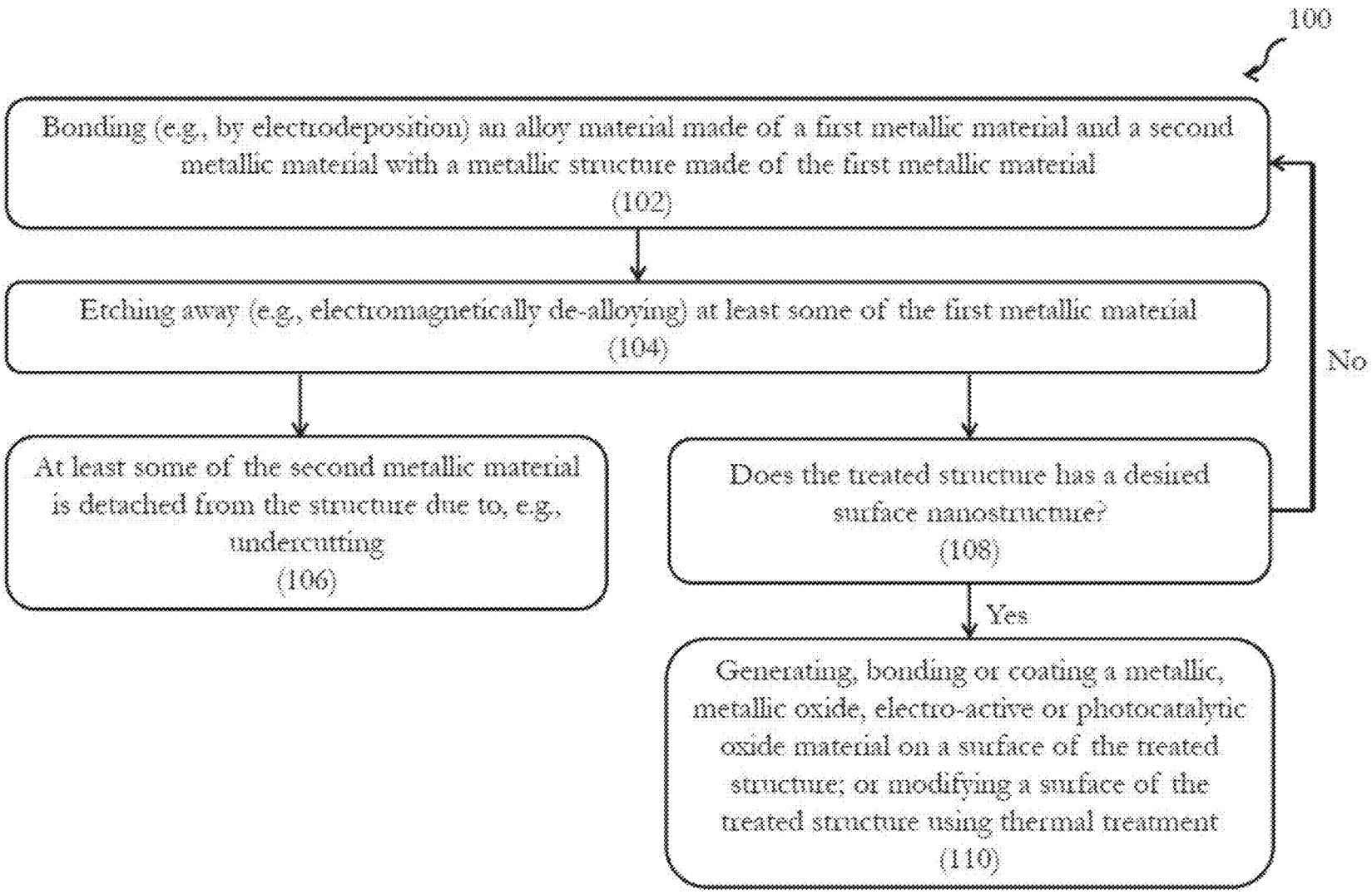
FIG. 1 is a flow diagram showing a method for treating a surface of a metallic structure in accordance with one embodiment of the present invention.

Referring to FIG. 1, there is provided a method 100 for treating a surface of a metallic structure, the metallic structure being made of a first metallic material; the method comprising the steps of: (a) bonding an alloy material made of the first metallic material and a second metallic material with the structure; and (b) removing or etching away at least some of the first metallic material from a structure obtained after step (a) so as to obtain a treated structure with an increased specific surface area compared with the metallic structure before treatment.

FIG. 1 illustrates a method 100 for treating a surface of a metallic structure (for example, an open-cell metal foam) made of a first metallic material in accordance with one embodiment of the present invention. The method 100 begins in step 102, in which an alloy material made of the first metallic material and a second metallic material is bonded to the metallic structure by, for example, electrodeposition. Preferably, the metallic structure is made of the first metallic material only; and the alloy material is made of the first metallic material and the second metallic material only. Also, the first metallic material is chemically more reactive than the second metallic material. The alloy material may be in the form of micro-isles, particles, granules, etc. In one embodiment, in step 102, an electrochemical cell may be used for electrodepositing the alloy material onto the metallic structure. The electrochemical cell may comprise a first electrode (the metallic structure to be treated), a second electrode, and an optional third reference electrode electrically connected with an electrolyte. The electrolyte may comprise a solution with ions of the first metallic material, ions of the second metallic material, and an acid.

The method 100 then proceeds to step 104, in which at least some of the first metallic material is etched away, for example, by electromagnetically de-alloying. The first metallic material that is etched away in step 104 may originally belong to both the alloy material and the metallic structure; or alternatively, belong to the alloy material only. Preferably, step 104 is carried out in a solution with ions of the first metallic material, ions of the second metallic material and an acid, which may contain the solution of the electrolyte used in step 102. In one embodiment, the solution used in step 104 may include or further include HCl, $HNO_3$, $H_2SO_4$, or ammonium.

In one embodiment, the electrodeposition in step 102 is carried out by applying a first voltage for a first duration to the structure; and the de-alloying in step 104 is carried out by applying a second voltage different from the first voltage for a second duration to the structure. The first and second durations may each be between 1 to 120 seconds, and more preferably, between 1 to 60 seconds. In one example, the first and second voltages may be in the form of a voltage wave such as AC square or sinusoidal voltage wave, i.e., one of the first voltage and the second voltage is a negative voltage, and another of the first voltage and the second voltage is a positive voltage. The voltage wave may be periodic.

Upon completion of step 104, the resulting structure has a nanostructured surface with nano-pores and thus has an increased specific surface area and surface roughness compared with the initial metallic structure before treatment.

Following the etching away of at least some of the first metallic material in step 104, in step 106, at least some of the second metallic material is also detached from the structure as or after the first metallic material is etched away. In one embodiment, all of the second metallic material is detached from the structure after some of the first metallic material is etched away. The detachment is preferably due to undercutting. In the present invention, the second metallic material detached from the structure in step 104 is in the form of particles that may have nano-pores. These second metallic materials may be recycled or processed for further use.

In step 108, if the treated structure obtained after step 104 does not have a desired surface nanostructure, e.g., the size and/or number of pores are not ideal for a particular application, method 100 returns to step 102 to repeat the bonding and etching away steps 102, 104 until the desired surface nanostructure is obtained. In one embodiment, steps 102 and 104 are repeated for 1 to 300 times, and more preferably, 20 to 160 times.

Upon obtaining a treated structure with a desired surface nanostructure, method 100 then proceeds to step 110, in which the structure is further treated for specific applications. In step 110, the structure with desired surface nanostructure may be further processed by generating, bonding or coating a metallic, metallic oxide, electro-active or photocatalytic oxide material on a surface of the treated structure; or by modifying a surface of the treated structure using thermal treatment.

In the method illustrated in FIG. 1, the first metallic material may be an aluminium-based material, a copper-based material, a zinc-based material, or silver-based material, e.g., aluminium, copper, zinc, or silver. The second metallic material may be a nickel-based material (e.g., nickel), platinum, or gold. Other metallic materials such as can be used as long as the first metallic material is chemically more reactive than the second metallic material. Preferably, the metallic structure used in the method of FIG. 1 is porous, and may be in the form of a foam, a foil, a wire, or a mesh. The metallic structure may be a closed-cell metal foam or more preferably an open-cell metal foam. Examples of these metal foams include aluminium foam, cadmium foam, cobalt foam, copper foam, iron foam, lead foam, molybdenum foam, nickel foam, niobium foam, rhenium foam, silver foam, tantalum foam, tin foam, titanium foam, zinc foam, etc.

FIG. 2 is a flow diagram showing an exemplary application of the method 100 of FIG. 1. In FIG. 2, an open-cell copper foam is used as the metallic structure, and nickel-copper (Ni—Cu) micro-isles or particles are used as the alloy material. In the method 200 of FIG. 2, the copper foam is repetitively treated with two steps. In the first step 202, micro-isles of Ni—Cu alloy are electrodeposited onto the ligaments of the copper foam. In the second step 204, electrochemical dealloying is applied to selectively etch away the exposed copper components, including the copper components in the Ni—Cu isles and on the uncovered ligament surface.

In the embodiment of FIG. 2, the nickel components in the deposited micro-isles serve as tiny masks to effectively shield the copper ligament surface from etching. The nickel component, preferably in the form of nano-porous particles, is then removed by undercutting as a result of the etching away of the copper. Following the removal of the nickel components, a roughened copper surface is obtained and the structure is ready for the next treatment cycle. Steps 202 and 204 may be repeated for a number of cycles, until a copper foam of a desired roughened surface (with surface nanostructure) is achieved. The resulting copper foam structure may be further processed, and may be used as SERS substrates and supercapacitor electrodes with enhanced performance.

Experiment

An experiment was performed on a copper foam using the method 200 illustrated in FIG. 2, and performances of the resulting structure in different applications are assessed.

A. Electrochemical Deposition of Ni—Cu Alloy and Dealloying of Copper

The electrochemical deposition and dealloying steps in FIG. 2 were carried out at room temperature using a computer-controlled potentiostat (HEKA Elektronik, PG310) in a three-electrode electrochemical cell which contained a saturated calomel reference electrode, a platinum ring as the counter electrode, and the copper foam as the working electrode. An aqueous solution of 0.005M copper sulfate pentahydrate (Riedal-Dehaën), 0.5M nickel (II) sulfamate tetrahydrate (Aldrich, 98%), and 06 M boric acid (Riedal-Dehaën) was used as the electrolyte. A small amount of ethanol (final concentration, 0.1 vol. %) was added into the electrolyte before the electrochemical treatment for better wetting the specimen. A voltage square-wave was applied which periodically modulated between two extreme values for n cycles: a cathodic voltage of $V_1$ for a time duration of $t_1$ for electrodepositing the Ni—Cu alloy isles, and an anodic voltage of $V_2$ for a time duration of $t_2$ for selectively etching copper (in one example, $V_1$=−0.82 V, $V_2$=0.5 V, $t_1$=$t_2$=10 seconds, and n=80). To obtain the precipitates from the reaction electrolyte, the reaction electrolyte was first centrifuged at 4000 rpm for 10 minutes. The precipitates were then washed for several times by being centrifuged in water at 4000 rpm for 10 minutes.

B. Characterizations

Figure 3:
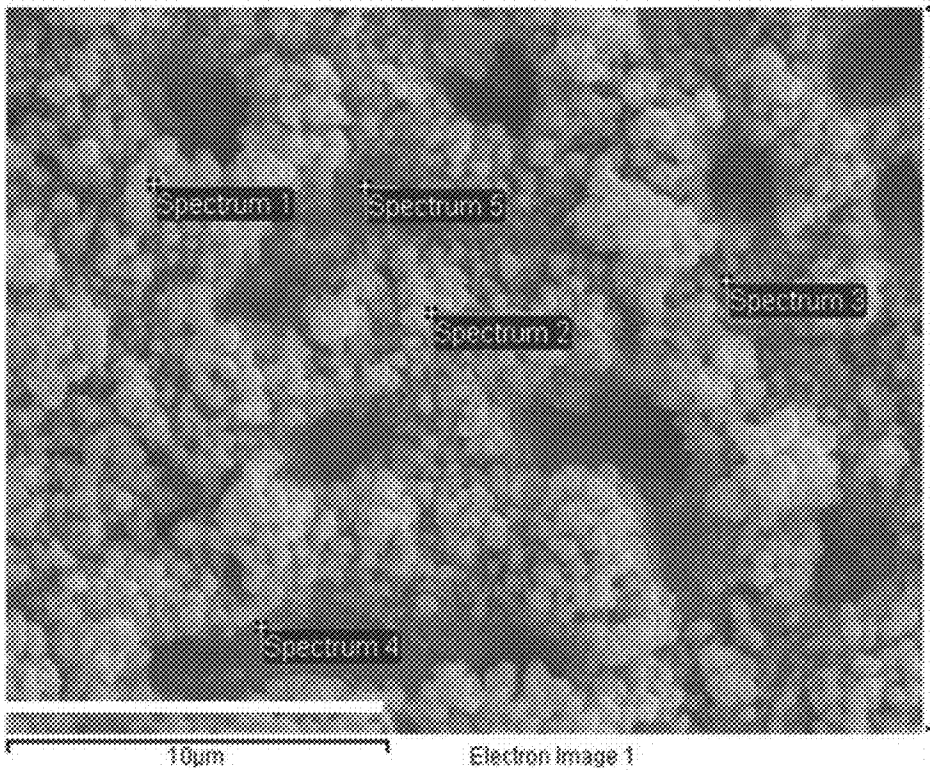
FIG. 3 is an EDX measurement of the roughened copper foam fabricated based on the method of FIG. 2.

A scanning electron microscope (SEM, JEOL JSM-820) equipped with an energy dispersive X-ray (EDX) spectrometer (Oxford INCA 7109) was used to examine sample morphology and chemical composition. FIG. 3 shows an EDX measurement of the roughened copper foam fabricated based on the method of FIG. 2. The scale bar in FIG. 3 indicates 10 μm. As shown in FIG. 3, upon repetitive electrodeposition and dealloying treatment based on the method of FIG. 2, the copper foam was greatly roughened, with the composition kept to be pure copper.

Figure 4A:
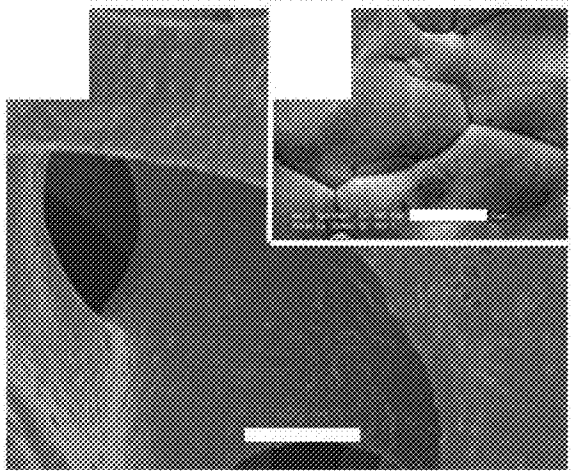
FIG. 4*a* is an SEM image (with a low magnification view and a high magnification insert) of the original copper foam without be treated with the method of FIG. 2.
Figure 4B:
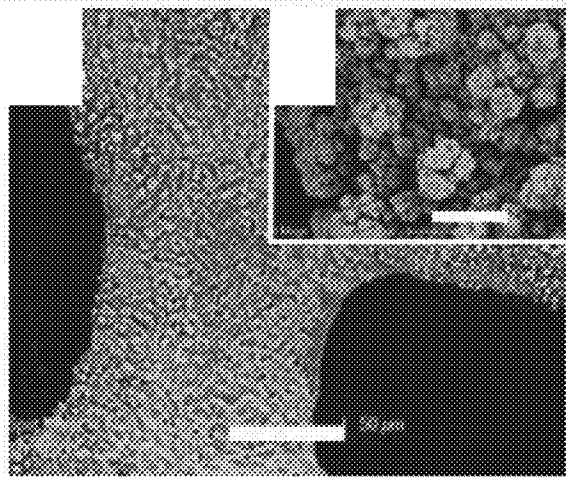
FIG. 4*b* is an SEM image (with a low magnification view and a high magnification insert) of the copper foam treated using the method of FIG. 2.
Figure 4C:
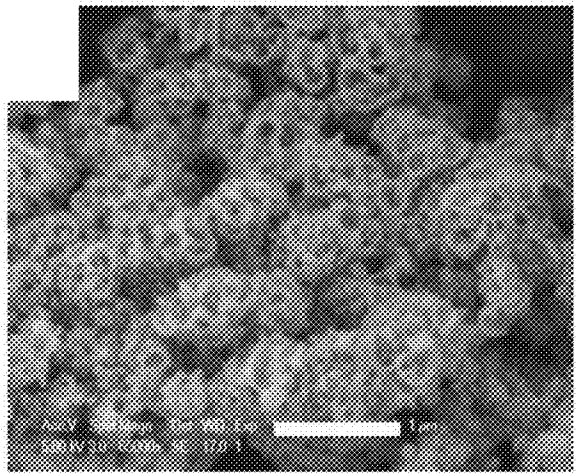
FIG. 4*c* is an SEM image of nano-porous nickel particles generated during the roughening treatment of the method of FIG. 2.
Figure 4D:
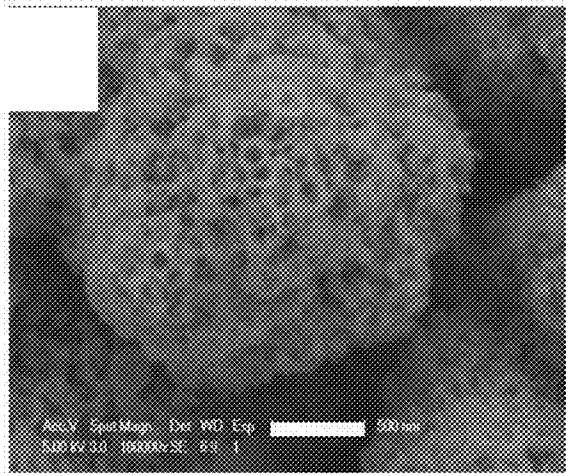
FIG. 4*d* is an enlarged SEM image of a nano-porous nickel particle generated during the roughening treatment of the method of FIG. 2.

X-ray diffraction (XRD) patterns were collected using an X-ray diffractometer (Rigaku SmartLab) using Cu Kα radiation. FIGS. 4*a* to 4*d* are SEM images of the original copper foam without treatment (FIG. 4*a*), the roughened copper foam after treatment using the method of FIG. 2 (FIG. 4*b*), and the nano-porous nickel particles (FIGS. 4*c* to 4*d*) generated during the roughening treatment of FIG. 2. The scale bars indicate 50 μm in the low magnification views of FIGS. 4*a* and 4*b;* 1 μm in FIG. 4*c;* 500 nm in FIGS. 4*d*; and 5 μm in the high magnification inserts (upper right corner) of FIGS. 4*a* and 4*b*. FIG. 4*b* clearly shows that the roughened copper foam features a nanostructured surface decorated with nano-pores or porous nanoparticles. In the experiment above, black precipitates were produced in the electrolyte, and they were nano-porous nickel micro-particles as illustrated in FIGS. 4*c* and 4*d*.

Brunauer-Emmett-Teller (BET) surface area and total pore volume were tested on a Quantachrome Nova 1200e Surface Area Analyzer. In the present embodiment, BET surface area measurements showed that the specific surface area of the copper foam changed from 0 $m^2/g$ before the roughening treatment to 22 $m^2/g$ after the roughening treatment.

Figure 5:
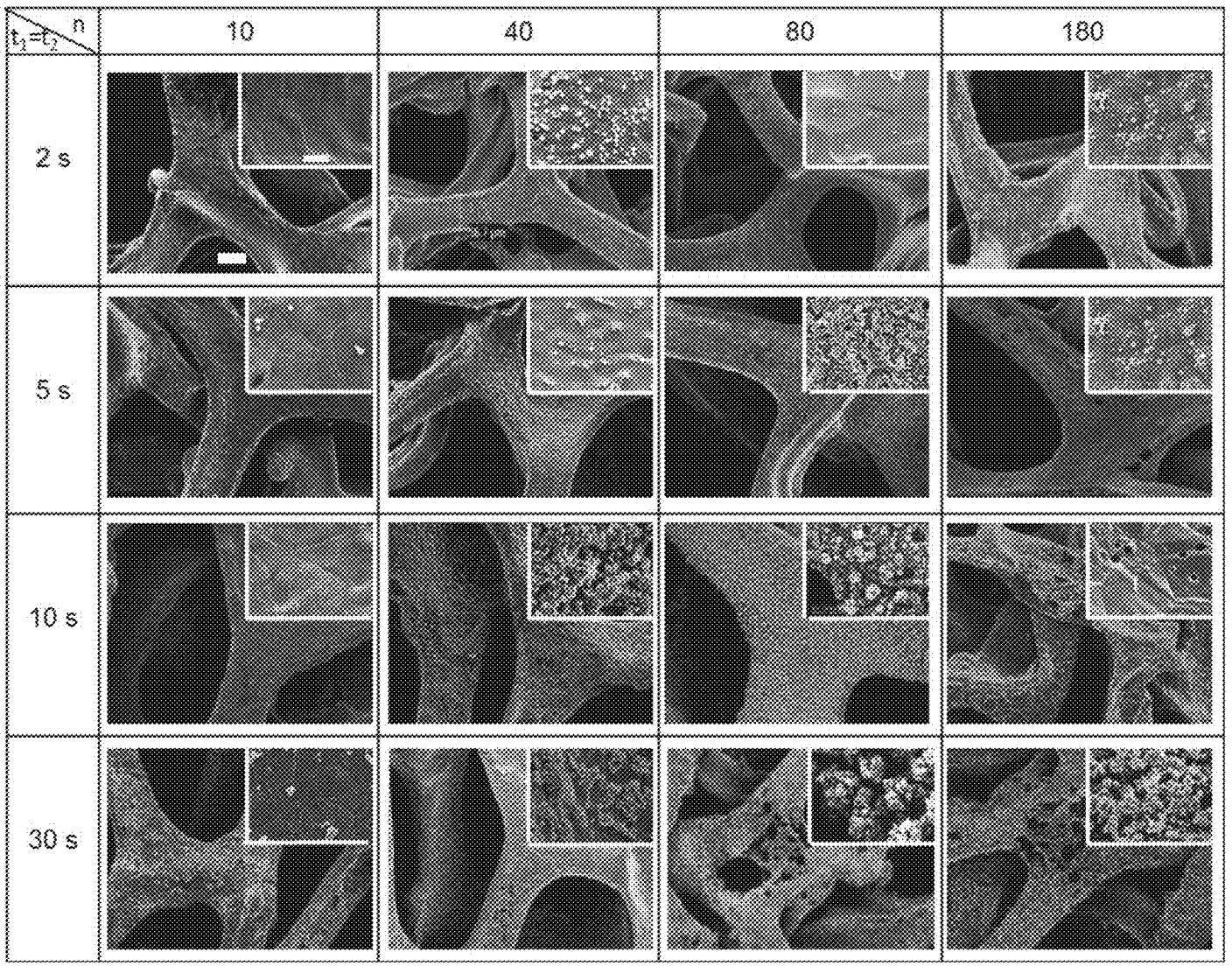
FIG. 5 is a table showing SEM images of copper foam samples prepared using the method of FIG. 2, with different electrodeposition and dealloying durations and treatment cycle number.

The effects of different electrodeposition and dealloying durations ($t_1$=$t_2$=2, 5, 10, 30 seconds) and treatment cycle number (n=10, 40, 80, 180) were further investigated. The table in FIG. 5 SEM images of different copper foam samples prepared/treated using the method of FIG. 2 with different parameters (electrodeposition at −0.82 V time for a time duration of $t_1$, dealloying at 0.5 V for a time duration of $t_2$, repeated for n cycles). All the images in FIG. 5 share the same scale bars: 50 μm for the low magnification views and 5 μm for the high magnification insets. As shown in FIG. 5, for given time periods $t_1$ and $t_2$, the foam would gradually be more roughened with an increased cycle number n. However, an excessively large cycle number n would lead to collapse of the whole foam framework. Similarly, for a given cycle number n, the foam was more roughened with longer time periods $t_1$ and $t_2$. However, excessively long time periods $t_1$ and $t_2$ would result in the collapse of the whole foam framework. In one embodiment of the present invention and in the subsequent discussion, time periods $t_1$, $t_2$ of 10 seconds and cycle number n of 80 are chosen to produce copper foams, as this combination may provide an optimal balance between obtaining a greatly roughened surface and maintaining structural integrity of the foam framework in this particular example.

Figures 6A, 6B, 6C:
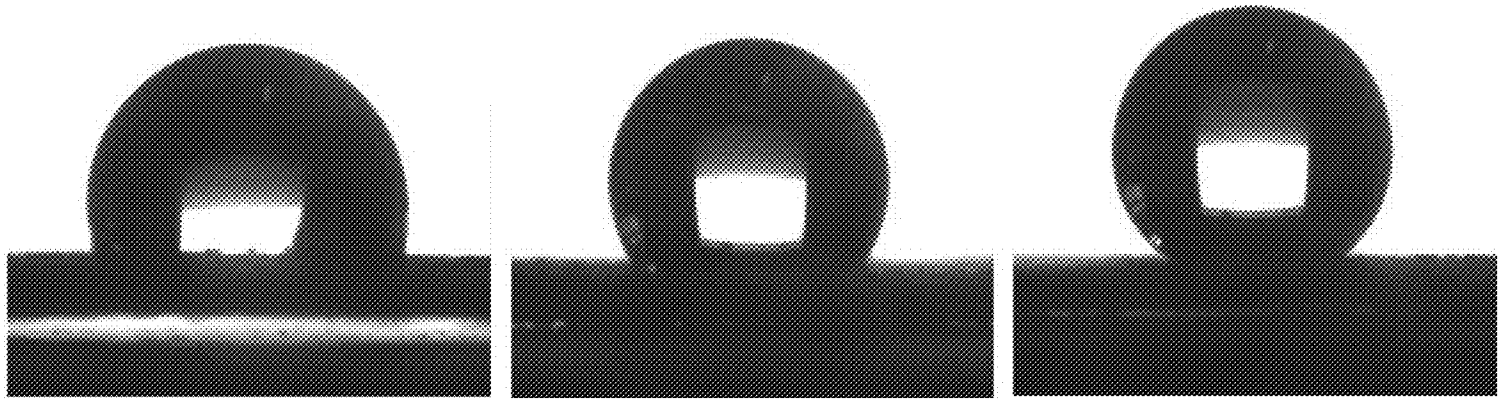
FIG. 6*a* shows a static-contact-angle image of a water droplet on the original copper foam without being treated with the method of FIG. 2.
FIG. 6*b* shows a static-contact-angle image of a water droplet on a copper foam treated using the method of FIG. 2 in which the electrodeposition duration is 5 seconds, the dealloying duration is 5 seconds and the cycle number is 80.
FIG. 6*c* shows a static-contact-angle image of a water droplet on a copper foam treated using the method of FIG.

Static water contact angle measurements were conducted at room temperature using a ramé-hart Model 500 Advanced Contact Angle Goniometer equipped with a CCD camera (30 fps) and the DROPimage Advanced Software. FIGS. 6*a* to 6*c* show static-contact-angle images of water droplets on the original copper foam (FIG. 6*a*) and on the treated roughened copper foams (FIGS. 6*b* and 6*c*). In FIG. 6*b*, the copper foam was electrodeposited for 5 seconds and then dealloyed for 5 seconds, and the process was repeated for 80 cycles. In FIG. 6*c*, copper foam was electrodeposited for 10 seconds and then dealloyed for 10 seconds, and the process was repeated for 80 cycles. The water contact angle from static water contact angle measurements was found to be 117° on the untreated copper foam (FIG. 6*a*), and 147° on the roughened foam (FIG. 6*c*). Also, the hydrophobicity on the copper foam in FIG. 6*c* is greater than that in FIG. 6*b*, which is in turn greater than that in FIG. 6*a*. This hydrophobicity increase on the more roughened copper foams is due to the increased surface roughness on the foams.

C. Silver Coating for SERS Applications

Sliver nanoparticles were bonded to the original untreated copper foam and to the roughened copper foam obtained using the method of FIG. 2 for comparison. The roughened copper foam bonded with sliver nanoparticles as described below is particularly suitable for use in Surface-Enhanced Raman Scattering (SERS) applications.

In this example, the copper foams were immersed into an aqueous solution of $AgNO_3$ (40 mL, 0.8 g/L), which was heated to 90° C. 2 ml sodium citrate (1.0 wt.%) was added dropwise to the solution with stirring (for ~30 s) until the color of the solution turned into light yellow. For SERS measurements, the silver-coated copper foam was soaked into a Rhodamine B ($10^{-6}$ M) solution for 3 hours. SERS measurements were performed on a Renishaw 2000 microscope equipped with a HeNe laser (632.8 nm) of 17 mW power with the laser intensity of 10% and the beam spot of 2 μm wide. The two-dimensional point-by-point SERS mapping images were conducted in 2 μm steps across an area of approximately 40 μm by 50 μm. The data acquisition time of each spectrum was 1 second.

FIGS. 7*a* and 7*b* show the SERS mapping images at 1362 $cm^{-1}$ of the original copper foam (FIG. 7*a*) and roughened copper foam (FIG. 7*b*) decorated with silver nanoparticles. The scale bars indicate 20 μm in the Raman spectra of FIGS. 7*a* and 7*b*, and 5 μm in the SEM images (upper left corner) of the corresponding samples in FIGS. 7*a* and 7*b*. In the experiment, the Raman spectra were collected in 2 μm steps. The two-dimensional point-by-point SERS mapping images clearly show that the roughened foam enabled much stronger SERS enhancement than the untreated one. A closer look at the sample surface by SEM reveals that the silver nanoparticles (around 100-200 nm big) on the roughened foams were much smaller than those (nearly 1 μm big) on the original foam. As a result, the treated foam in FIG. 7*b* shows a rougher silver surface with possibly more hot spots compared with that in FIG. 7*a*, and this is favorable for enabling the SERS enhancement effect.

D. Thermal Oxidation for Supercapacitor Applications

Copper oxide nanowires were grown on the untreated and treated copper foams using a thermal oxidation procedure for further study.

In this example, the copper foams were thermally oxidized in air at 300° C. for 1 hour. The supercapacitor properties of the resulting foam structure were tested at room temperature in a KOH (6 M) aqueous solution using a three-electrode system which was connected to a potentiostat (PAR Verastat3). The cyclic voltammetry (CV) performance was tested on a CHI660E Electrochemical Workstation with a scan rate of 10 mV $s^{-1}$ and scan range of 0V to 0.6V. In the experiment, both the untreated and roughened foams turned from red-orange with a metallic luster into dull black upon thermal oxidation, due to the light absorption and scattering by the surface nanowires.

FIGS. 8*a* and 8*b* show SEM images of the original untreated copper foam and the roughened copper foam obtained using the method of FIG. 2 after thermal oxidation. The scale bars indicate 5 μm for the lower magnification images, and 500 nm for the insets. In FIG. 8*a*, the original untreated copper foam has scarcely distributed short broken nanowires arranged on its surface. This is likely due to the fact that the copper oxide nanowires fell off the copper substrate during the thermal oxidation as a result of the thermal stress induced between the oxide and the substrate. In FIG. 8*b*, however, a much denser array of longer oxide nanowires of fairly uniform diameters was produced on the roughened copper foam treated using the method of FIG. 2. This indicates that the roughened nano-structured framework may be able to alleviate the thermal stress and to provide more active sites for initiating thermal growth of the nanowires. FIG. 9 shows an XRD pattern of the copper foam treated using the method of FIG. 2 after thermal oxidation and it shows that the thermally generated nanowires consisted of both CuO and $Cu_2O$ phases.

The untreated copper foam covered with copper oxide nanowires and the roughened copper foam (treated using the method of FIG. 2) covered with copper oxide nanowires were further studied for supercapacitor applications by serving directly as an electrode system.

FIGS. 10*a* and 10*b* show the cyclic voltammograms of the copper oxide nanowires grown on the original untreated copper foam (FIG. 10*a*) and on the roughened copper foam (FIG. 10*b*). The cyclic voltammetry (CV) measurements show that the roughened foam provides a much increased capacitance, as evident by the larger area enclosed by the CV curve in FIG. 10*b* than in FIG. 10*a*.

FIGS. 10*c* and 10*d* show the charge/discharge curves of the copper oxide nanowires grown on the original untreated copper foam (FIG. 10*c*) and on the roughened copper foam (FIG. 10*d*). Remarkably longer discharging time was observed in the charge/discharge curves for the oxide nanowires on the roughened foam. The specific capacitance can be calculated using the following equations:

$$C_m = It/mV$$

$$C_a = It/\Delta V$$

where $C_m$ and $C_a$ are the mass- and area-specific capacitance, respectively, I is the galvanic discharge current, t is the full discharge time, m and A are the mass and area of the electrode, respectively, and V is the potential window.

FIG. 10*e* shows the chronopotentiometric curves of different current density for the oxide nanowires grown on the roughened copper foam. From the discharging curve at 2 $mA/cm^2$, the capacitances were determined to be 58.6 F/g and 266 $mF/cm^2$ for the electrode based on the roughened foam, and 0.74 F/g and 3.3 $mF/cm^2$ for the untreated-foam-based electrode. This dramatic improvement observed on the roughened foam is due to the larger nanostructured surface area, which produces a denser array of the electro-active oxide nanowires. A charge collector of a large specific surface area is particularly useful for maximizing the usage of the coated electro-active materials, increasing their specific capacitance, and boosting their charge/discharge rates.

In all, the above results illustrated in FIGS. 10*a* to 10*e* showed that the copper foam treated with the method of FIG. 2, after thermal oxidation, provides better performance than the untreated thermally oxidized foam.

Using copper foam as an exemplary material system, the above description demonstrated a convenient electrochemical method for effectively roughening metal foams and thus producing a novel kind of hierarchically porous metal framework whose surface morphology can be easily controlled by adjusting the electrochemical parameters. Furthermore, the byproduct of the proposed electrochemical fabrication of the bulk metal foam is the nano-porous metallic particles featuring an extraordinarily large surface area, and they are potentially desirable for catalysis and electrode applications. Unlike other depositing methods where materials are deposited onto the substrate where the adhesion/bonding of the coating materials can be a challenge for maintaining the structural integrity and stability, the treatment method in the embodiments of the present invention is essentially to roughen the material by gradually carving its surface, eliminating the adhesion/bonding difficulty. The present invention provides a method that directly modifies the metal foam by carving its ligaments to generate surface roughness and nano-pores.

Whilst the above description is made with reference to metal foams, the design methods and fabrication strategy in the embodiments of the present invention are generally applicable to other metallic structures (e.g., metal foils, wires or meshes) for improving their performance in various applications.

Some technical advantages of the embodiments of the present invention include:

- Simple experimental setup without the need to use expensive equipment such as vacuum, clean room, or sophisticated control systems, which are generally required by other micro-processing technologies for making nano-porous metallic structures;
- Compatible with convenient large-area fabrication with high uniformity that can be readily mass produced on an industrial scale;
- Tailor-made, elaborate structural profiles can be accurately targeted and achieved with high purity. The structural features of the product can be easily adjusted by modifying the experimental parameters of electrochemical treatment;
- A wide range of metals and metallic compound species can be fabricated; and
- The method includes simple steps that can be readily automated for industry-scale mass production.

Further/other advantages of the present invention in terms of cost, structure, function, ease of manufacture, economics, etc., will become evident to a person skilled in the art upon reading the above description and the reference drawings.

Embodiments of the present invention can be applied to various applications and fields, for example:

- Charge collectors/mass support for the electro-active materials for lithium ion batteries (LIBs)
  - The fabrication techniques of embodiments of the present invention can be used to increase the surface area of the substrate for electrode materials that are of strong interest to the market of lithium ion batteries.
- Supercapacitors
  - Embodiments of the present invention can be used to provide a type of economical electrode substrate materials for supercapacitors.
- Sensors
  - Embodiments of the present invention can be used to apply novel functions of electrodes to traditional nanostructured materials that are used as sensor.
- SERS substrates
  - Embodiments of the present invention can be used to produce porous metals with a large nanostructured surface area, making them attractive SERS substrates.
- Catalyst
  - Embodiments of the present invention can be used to produce robust 3D porous metal networks of large surface area, well-suited for catalysis applications.
- Photocatalyst
  - Embodiments of the present invention made possible the fabrication of electrode structure with a coating of photocatalyst substances (such as Cu2O), in which the highly absorbent materials fabricated by this invention trap and transfer the photonic energy to the photocatalysts.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

Any reference to prior art contained herein is not to be taken as an admission that the information is common general knowledge, unless otherwise indicated.

The invention claimed is:

1. A method for treating a surface of a metallic structure, the metallic structure being made of a first metallic material; the method comprising the steps of:

(a) bonding an alloy material made of the first metallic material and a second metallic material with the structure; and (b) etching away at least some of the first metallic material from a structure obtained after step (a) so as to obtain a treated structure with an increased specific surface area compared with the metallic structure before treatment.

2. The method of claim 1, wherein the treated structure has a nanostructured surface with nano-pores.

3. The method of claim 2, wherein step (a) comprises electrodepositing the alloy material onto the metallic structure.

4. The method of claim 3, wherein an electrochemical cell is used for electrodepositing the alloy material onto the metallic structure; the electrochemical cell comprises a first electrode, a second electrode and an electrolyte in electrical connection; wherein the metallic structure to be treated being connected as the first electrode; and the electrolyte comprises a solution with ions of the first metallic material and ions of the second metallic material.

5. The method of claim 4, wherein the solution of the electrolyte further comprises an acid.

6. The method of claim 4, wherein step (b) comprises electrochemically de-alloying at least some of the first metallic material.

7. The method of claim 6, wherein the de-alloying in step (b) is carried out in a solution with ions of the first metallic material, ions of the second metallic material and an acid.

8. The method of claim 6, wherein the de-alloying in step (b) is carried out in an acidic solution comprising HC1, $HNO_3$, $H_2SO_4$, or ammonium.

9. The method of claim 7, wherein the electrodeposition in step (a) is carried out by applying a first voltage for a first duration to the metallic structure; and the de-alloying in step (b) is carried out by applying a second voltage different from the first voltage for a second duration to the structure obtained after step (a).

10. The method of claim 9, wherein the first duration is 1-60 seconds.

11. The method of claim 9, wherein the second duration is 1-60 seconds.

12. The method of claim 9, wherein one of the first voltage and the second voltage is a negative voltage, and another of the first voltage and the second voltage is a positive voltage.

13. The method of claim 1, wherein in step (b) at least some or all of the second metallic material is detached from the structure obtained after step (a) as the first metallic material is etched away.

14. The method of claim 13, wherein the second metallic material detached from the structure obtained after step (a) is in a form of particles.

15. The method of claim 14, wherein the detached second metallic material particles have nano-pores.

16. The method of claim 1, further comprising the step of:

(c) repeating steps (a) and (b).

17. The method of claim 16, wherein steps (a) and (b) are repeated for 20 to 160 times.

18. The method of claim 1, wherein the alloy material is the form of micro-isles.

19. The method of claim 1, wherein the first metallic material is chemically more reactive than the second metallic material.

20. The method of claim 19, wherein the first metallic material is an aluminium-based material, a copper-based material, a zinc-based material, or a silver-based material; and the second metallic material is a nickel-based material, platinum, or gold.

21. The method of claim 1, wherein the metallic structure is porous.

22. The method of claim 21, wherein the metallic structure is in the form of a foam, a foil, a wire, or a mesh.

23. The method of claim 21, wherein the metallic structure is an open-cell metal foam.

24. The method of claim 1, further comprising the step of:

(d) generating, bonding or coating a metallic or metallic oxide material on a surface of the treated structure.

25. The method of claim 1, further comprising the step of:

(e) generating, bonding or coating an electro-active or photocatalytic oxide material on a surface of the treated structure.

26. The method of claim 1, further comprising the step of:

(f) modifying a surface of the treated structure using thermal treatment.

27. A method for treating a surface of an open-cell metal foam, the open-cell metal foam being made of a first metallic material; the method comprising the steps of:

(a) electrodepositing alloy material micro-isles made of the first metallic material and a second metallic material onto the open-cell metal foam; and (b) electrochemically de-alloying at least some of the first metallic material from a structure obtained after step (a) so as obtain a treated open-cell metal foam with a nanostructured surface having nano-pores.

28. The method of claim 27, further comprising the step of:

(c) repeating steps (a) and (b).

29. The method of claim 27, further comprising at least one of the following step:

(d) generating, bonding or coating a metallic or metallic oxide material on a surface of the treated open-cell metal foam;

(e) generating, bonding or coating an electro-active or photocatalytic oxide material on a surface of the treated open-cell metal foam; and (f) modifying a surface of the treated open-cell metal foam using thermal treatment.

30. The method in claim 27, wherein in step (b) at least some or all of the second metallic material is detached from the structure obtained after step (a) as the first metallic material is de-alloyed, and wherein the detached second metallic material is a form of particles having nano-pores.

31. The method in claim 27, wherein the first metallic material is an aluminium-based material, a copper-based material, a zinc-based material, or a silver-based material; and the second metallic material is a nickel-based material, platinum, or gold.

* * * * *